United States Patent [19]

Takahashi et al.

[11] 4,359,192

[45] Nov. 16, 1982

[54] TRIBOELECTRIC POWDER SPRAYING GUN

[75] Inventors: Akira Takahashi, Okazaki; Koyu Takase, Toyota; Hiroyoshi Kako, Aichi; Nobuo Kobayashi, Toyota, all of Japan

[73] Assignee: Toyota Jidosha Kogyo Kabushiki Kaisha, Japan

[21] Appl. No.: 233,950

[22] Filed: Feb. 12, 1981

Related U.S. Application Data

[63] Continuation of Ser. No. 78,847, Sep. 25, 1979, abandoned.

[30] Foreign Application Priority Data

Sep. 26, 1978 [JP] Japan ..... 53-131184

[51] Int. Cl.[3] ..... B05D 1/04; B05C 5/04

[52] U.S. Cl. ..... 239/692; 239/488; 427/27; 118/621; 118/627

[58] Field of Search ..... 427/27; 239/697, 698, 239/699, 690, 692, 590.3, 590.5, 488, 494, 497; 118/627, 621

[56] References Cited

U.S. PATENT DOCUMENTS

| | | | |
|---|---|---|---|
| 2,435,605 | 2/1948 | Rowell | 239/488 |
| 3,237,865 | 3/1966 | Kovach | 239/488 X |
| 3,248,606 | 4/1966 | Fraser | 239/697 |
| 3,296,015 | 1/1967 | Juvinall et al. | 427/27 |
| 3,344,558 | 10/1967 | Kirkland | 239/497 X |
| 3,498,540 | 3/1970 | Adams | 239/698 |
| 3,521,815 | 7/1970 | Szasz | 239/698 |
| 3,698,636 | 10/1972 | Szasz | 239/697 |
| 3,903,321 | 9/1975 | Schaad | 427/27 |
| 4,072,129 | 2/1978 | Bright et al. | 239/697 X |
| 4,090,666 | 5/1978 | Peck | 239/692 |
| 4,133,485 | 1/1979 | Bouvin | 239/488 |

FOREIGN PATENT DOCUMENTS 53-77236 7/1978 Japan .

*Primary Examiner*—Shrive P. Beck

*Attorney, Agent, or Firm*—Finnegan, Henderson, Farabow, Garrett & Dunner

[57] ABSTRACT

A triboelectric powder spraying gun is provided which can produce an increased deposition efficiency and an improved coated surface. The spraying gun comprises an earthed or high voltage-impressed conductive nozzle having, as a lining, a plastic material which possesses an electrification series remarkably different from that of a powdered paint, in which said powdered paint is transferred to said nozzle so that it is triboelectrically charged within said nozzle, and a turbulence generator arranged inside of said nozzle. The surface of said turbulence generator is coated with a plastic material possessing an electrification series remarkably different from that of said powdered paint.

3 Claims, 3 Drawing Figures

TRIBOELECTRIC POWDER SPRAYING GUN

This is a continuation, of application Ser. No. 06/078,847, filed Sept. 25, 1979 now abandoned.

FIELD OF THE INVENTION

This invention relates to a triboelectric powder spraying gun and more particularly an improved triboelectric powder spraying gun which can provide a smooth and uniform coating surface and an increased deposition efficiency.

DESCRIPTION OF THE PRIOR ART

Various methods have been proposed and used as powder coating methods. Particularly, a powder coating method which utilizes corona discharge for electrifying powder particles has been extensively used in the field. The corona discharge method generally comprises arranging a corona pin inside of or near the tip portion of a spraying gun, impressing a high voltage between said corona pin and an earthed substrate to be coated to generate ions from said pin, and then electrically charging the powder by means of the generated ions and, simultaneously, transferring the thus charged powder to said earthed substrate under the influence of an electric field formed in the preceding step, thereby resulting in a uniform powder coating. However, conventional spraying guns utilizing the corona discharging system have many unavoidable difficulties and drawbacks. Some of these as follows:

(1) Poor deposition efficiency

Desirable high deposition efficiency cannot be attained even if a relatively high voltage, such as −60 to −90 KV, is applied to the spraying gun. This is because the amount of the charge on powder particles is not notedly increased in spite of the relatively high voltage. As an example of the results of the corona discharging system, the deposition efficiency ($\eta$) of the powder coating carried out in a booth is 75% or less.

(2) Defective coating

When the thickness of the resulting coating is increased by any conventional method, the resulting coating will frequently show a defective surface, namely, a crater-like coated surface. This is because ions accumulated on the coating surface cause a dielectric breakdown of the coating surface.

Furthermore, another triboelectric powder spraying method has been used in the past. For instance, Japanese patent application No. 51-152,928, filed on Dec. 21, 1976, which was laid open on July 8, 1978 under Kokai No. 53-152,978, discloses that, if a triboelectric powder spraying method and apparatus is used to electrostatically coat a powdered paint having a remarkably large paint resistance, the resulting effects are better than that of the corona discharging system. The triboelectric powder spraying method of the prior application comprises subjecting the powdered material to triboelectrical electrification within a tubular passage having, as a lining, a layer of material which has an electrification series different from that of said powdered material, and then spraying the thus charged powdered material onto the substrate to be coated which has an opposite charge. However, this prior method cannot yet provide a satisfactory deposition efficiency and a complete and uniform coated surface, although it can attain a simplification of the spraying device and a speedup of the coating process.

SUMMARY OF THE INVENTION

The present invention overcomes these prior art difficulties and drawbacks by improving the conventional triboelectric powder spraying gun which comprises an earthed or high voltage-impressed conductive capillary having a plastic lining.

The triboelectric powder spraying gun according to this invention comprises an earthed or high voltage-impressed conductive nozzle having, as a lining, a plastic material which posseses an electrification series remarkably different from that of a powdered paint, in which said powdered paint is transferred to said conductive nozzle so that it is triboelectrically charged within said nozzle, and is characterized by further comprising a turbulence generator which is arranged inside of said nozzle.

In an aspect of this invention, the surface of the turbulence generator is coated with a plastic material possessing an electrification series remarkably different from that of the powdered paint. The plastic material may be the same or different from that of the lining applied to the conductive nozzle.

The plastic material can be optionally selected from a variety of resinous materials to which the powdered paint used herein does not adhere. Examples of plastic materials which do not adversely affect the powder coating include a fluorinated resin such as fluorocarbons, a vinyl resin such as vinyl chloride, and the like. A preferred plastic material is "Teflon" which is the trade name of polytetrafluoroethylene commercially available from the E. I. DuPont de Nemours & Co. Inc.

The turbulence generator of this invention can be formed in any possible configuration as long as it causes an effective swirl or vortex of the powdered paint. Typically, examples of the turbulence generator useful in this invention include a single blade, a combination of two or more guide blades and a round rod. The turbulence generator comprising a combination of two or more guide blades is especially useful with the described triboelectric powder spraying gun.

Furthermore, the turbulence generator can be made from any suitable metallic material such as aluminum, iron, steel, duralumin and the like or, if desired, it can be made only from Teflon to save the use of Teflon coating.

A variety of resinous powders are useful as the powdered paint when the powder coating is carried out by using the gun of the present invention. The powdered paint can be selected from, for example, thermoplastic resin powders such as low-pressure polyethylenes, high-pressure polyethylenes, polyamides, polyvinyl chlorides, vinyl acetates, polytetrafluoroethylenes and the like, and thermosetting resin powders such as epoxys and the like. Of course, the selection of an optimum resinous powder will depend upon such factors as the particular substrate to be coated, coating conditions, the desired coating and the like.

As previously described, the present invention suggests improving the known triboelectric powder spraying guns by disposing any turbulence generator within the conductive nozzle of the spraying gun. The turbulence generator causes a swirl or vortex of the powdered paint inside the nozzle thereby assuring a complete and uniform triboelectric electrification of all the powdered paint. Thus, the improved spraying gun according to the present invention can prevent the so-called "omission of the electrification" and, as a result of this, if can provide a high deposition efficiency of 95% or more which is not attained by the prior art. Of course, a formation of surface defects such as a crater-like coated surface is prevented through the use of the triboelectric powder spraying gun of the present invention. Furthermore, additional advantages such as a simplified structure of the gun, a speed up of the coating process, an improvement of the quality of the resulting coating, an economy of operating costs and the like is obtained by the spraying gun of the present invention.

DESCRIPTION OF THE PREFERRED EMBODIMENTS

Figure 1:
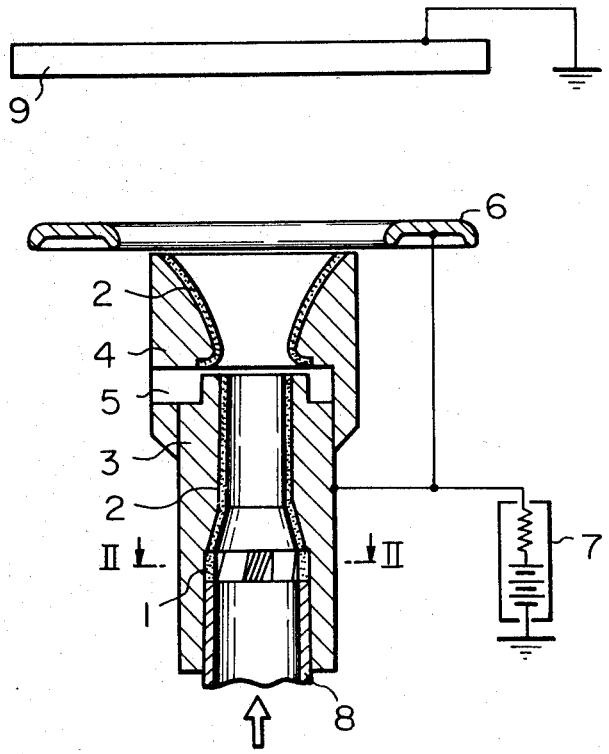
FIG. 1 is a simplified sectional view of the powder spraying gun according to a preferred embodiment of the present invention.

Referring now to FIG. 1, the triboelectric powder spraying gun according to this invention comprises a conductive nozzle 3 having connected thereto a paint feeding hose 8. The conductive nozzle 3 has, as a lining 2, a layer of plastic material which possesses an electrification series remarkably different from that of powders used in coating, namely, a powdered paint. This nozzle is used to spray the powdered paint (not illustrated) onto an earthed substrate to be coated 9.

A diffuser 4 having a lining 2 is fixedly mounted on a tip of the conductive nozzle 3. The diffuser 4 is further provided with an air inlet 5 which is effective in uniformly diffusing the powdered paint through the Coanda effect. The air inlet 5, as is illustrated in the drawing, is a ring-like slit or air gap formed between the nozzle 3 and the diffuser 4. Air is injected into the nozzle 3 through the inlet 5 and then flows along an inner wall of the diffuser 4. Thus, the powdered paint, a flow direction of which is indicated by the arrow in FIG. 1, is uniformly diffused while its transfer velocity is decreased with an increase in the inner diameter of the diffuser 4.

An electric field-forming electrode 6 is positioned in an outer peripheral portion of the diffuser 4. The electrode 6 may be either a ring-like electrode or a combination of two or more electrodes. The number, shape and configuration of electrode 6 may be optionally selected depending upon the desired effects and results. The electric field-forming electrode 6 enables the injected paint to be uniformly and fitly effectively sprayed on the earthed substrate to be coated 9. This is because the electrode 6 which is connected to a high voltage generator 7 can form an electric field (not illustrated).

The electrode 6 also prevents the undesirable spraying of the paint outside the substrate 9.

Figure 2:
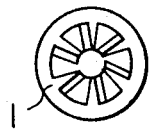
FIG. 2 is a sectional view of the turbulence generator taken along line II—II in FIG. 1.

FIG. 2 is a sectional view of the turbulence generator taken along line II—II in FIG. 1. In this case, the turbulence generator 1 is composed of six guide blades in order to effectively generate a swirl or vortex of the powdered paint. The number, shape and configuration of the turbulence generator 1 can be appropriately selected depending upon the desired results. In other words, if the turbulence generator is arranged inside of the spraying nozzle, the results will be better than that obtained in the absence of a turbulence generator. In addition, such results do not depend on the details of the generator used.

Figure 3:
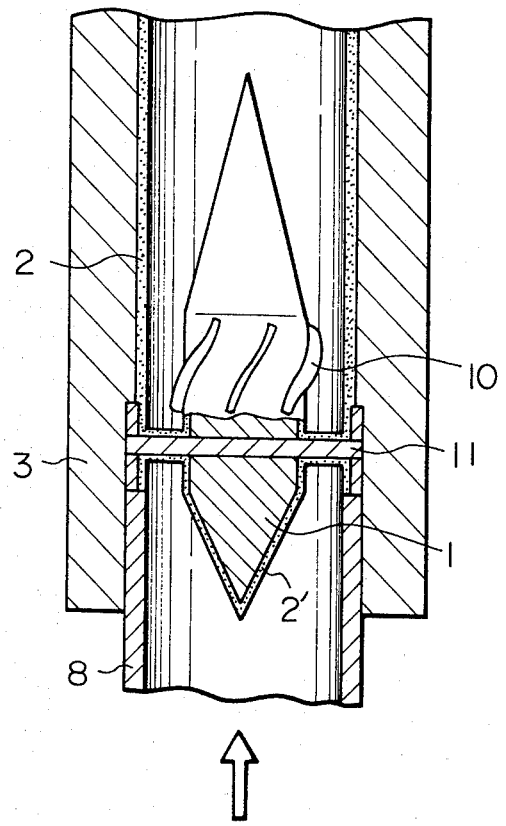
FIG. 3 is a simplified and enlarged sectional view of the turbulence generator and its peripheral portion of the powder spraying gun according to another preferred embodiment of the present invention.

FIG. 3 is a simplified and enlarged sectional view of the turbulence generator and the peripheral portion of the powder spraying gun according to this invention. Reference character 1 designates the body of the turbulence generator which is supported by a supporting rod 11 and on the surface of which a plastic coating 2' is applied. The plastic coating 2' comprises a resinous material which is the same as that of said coating 2 so that the powdered paint does not adhere to the surface of the turbulence generator 1. In this case, the turbulence generator 1 is provided with multiple guide blades 10.

The conductive nozzle 3 in the described triboelectric powder spraying gun can be earthed or high voltage-impressed with a voltage the polarity of which is the same as that of the charged powdered paint. The nozzle 3 can be optionally produced from a variety of conductive materials depending upon the desired effects. Preferred conductive materials are, for example, brass, aluminum and the like.

The lining 2 of the nozzle 3 and the coating 2' of the turbulence generator 1 may be formed from the same or different plastic materials, respectively, but said plastic materials should have an electrification series which is remarkably different from that of the powdered paint. For example, if an epoxy resin or an acrylic resin is used as the powdered material, fluorinated resins such as Teflon and the like are preferably applied as the lining or coating.

The electrode 6 in the described powder coating gun can be optionally impressed with a high voltage the polarity of which is identical to that of the charged paint, because the electrode 6 should not generate ions. As can be easily understood, the electrode 6 forms an electric field and, as a result of this, enables the powdered paint sprayed from the nozzle 3 to be uniformly coated on the full range of the earthed substrate 9. Additionally, the formed electric field prevents undesirable spraying of the powdered paint outside the predetermined range of the substrate 9. Preferably, the electrode 6 should have a configuration that is incapable of producing an electric discharge.

In carrying out the present invention, a triboelectric electrification is effected within the spraying nozzle 3 and, therefore, the powdered paint as well as the lining 2 and coating 2' are strongly charged to opposite polarities, respectively. Namely, the powdered paint is positively charged, and the lining 2 and coating 2' are negatively charged. The positively charged paint is sprayed together with air, while the negative charge accumulated in the lining 2 and cating 2' escapes adequately and timely to the earth because the nozzle 3 is earthed or high voltage-impressed. Therefore, the escape of the negative charge inhibits an excessive electrification of the negative charge in the lining 2 and coating 2', and thereby said negative charge is constantly maintained at a controlled level which effectively causes a sufficient triboelectric electrification.

The following example is included for a further understanding of the invention.

EXAMPLE

This example is carried out by using both a commercially available corona discharge powder spraying gun and the triboelectric powder spraying gun according to the present invention.

The following is a summary of the applied coating conditions:

| | |
|---|---|
| Air velocity in spraying booth: | 0.3 m/sec<br>Flow direction of air is parallel to the substrate to be coated |
| Substrate to be coated: | Flat plate<br>(size: 100 × 100 cm) |
| Distance between gun and substrate: | 20 cm |
| Discharge of paint: | about 100 g/min. |
| Powdered paint: | Epoxy resin powders |

The comparative results obtained from the corona discharge spraying gun and the triboelectric spraying gun (with or without the turbulence generator) are given in following Table I.

TABLE I

| | Spraying gun | Impressed voltage (KV) | Charge level (μC/g) | Deposition efficiency (% by wt.) | Current of corona discharge (μA) | Defective coated surface was formed at a coating thickness of: |
|---|---|---|---|---|---|---|
| | Type A | −60 | −0.55 | 56 | Ca. 3 | more than 100 μm |
| 1 | Type B | −60 | −0.8 | 68 | Ca. 25 | more than 70 μm |
| | Type C | −60 | −0.9 | 69 | Ca. 12 | " |
| | Type D | 0 | +1.3 | 77 | — | more than 300 μm |
| 2 | Type E | +60 | +1.4 | 83 | — | " |
| | Type F | 0 | +1.75 | 84 | — | More than 240 μm |
| 3 | Type G | +30 | +1.77 | 91 | — | " |
| | Type H | +60 | +1.88 | 96 | — | " |

Type of spraying guns used herein:
1 Types A, B & C . . . Corona discharge spraying gun
2 Types D & E . . . Triboelectric spraying gun (without turbulence generator)
3 Types F, G & H . . . Triboelectric spraying gun (with turbulence generator)

The data in Table I illustrates that Types F, G and H provide a deposition efficiency of more than 84% by weight and also prevent the formation of crater-like surface defects even if the coating layer is applied at a high thickness. That is, the triboelectric powder spraying guns according to the present invention produce an increased deposition efficiency and improved coated surface compared to the well-known corona discharge powder spraying guns and the triboelectric powder spraying guns that have no turbulence generator.

What we claim is:

1. In a triboelectric powder spraying gun for spraying powdered paint comprising an earthed or high voltage-impressed conductive nozzle having a portion lined with a plastic material which possesses an electrification series different from that of said powdered paint, in which said powdered paint is transferred to said lined portion of said conductive nozzle where it is triboelectrically charged; the improvement comprising a turbulence generator which includes a combination of two or more guide blades positioned internally of said nozzle and upstream of said lined portion of said nozzle and operable to cause a swirl or vortex of said powdered paint as it enters the lined portion of said nozzle to assure a more complete and uniform triboelectrification of said powdered paint.

2. In a triboelectric powder spraying gun for spraying powdered paint comprising an earthed or high voltage-impressed conductive nozzle having a portion lined with a plastic material which possesses an electrification series different from that of said powdered paint, in which said powdered paint is transferred to said lined portion of said conductive nozzle where it is triboelectrically charged; the improvement comprising a turbulence generator having a combination of two or more guide blades inside said nozzle and upstream of said lined portion of said nozzle and operable to cause a swirl or vortex of said powdered paint as it enters the lined portion of said nozzle without an increase in the volume of gas or air flow through said nozzle to assure a more complete and uniform triboelectrification of said powdered paint.

3. Triboelectric powder spraying gun as claimed in claim 1 or 2, wherein said plastic material is a fluorinated resin.

* * * * *